US005803454A

United States Patent [19]

Adell

[11] Patent Number: 5,803,454

[45] Date of Patent: Sep. 8, 1998

[54] COMBINED COASTER AND LOTTERY NUMBER PICKER

[76] Inventor: Robert Adell, 31800 S. Brandingham, Franklin, Mich. 48025

[21] Appl. No.: 86,029

[22] Filed: Jul. 6, 1993

[51] Int. Cl.[6] ..... A63F 3/06; A47G 23/03

[52] U.S. Cl. ..... 273/144 B; 273/148 R; 273/144 R; 248/346.11

[58] Field of Search ..... 273/144 B, 144 R, 273/148 R, 138 R, 113, 115; 248/346.1, 346.11

[56] References Cited

U.S. PATENT DOCUMENTS

| | | | |
|---|---|---|---|
| 3,188,040 | 6/1965 | Eichler | 273/113 |
| 4,807,881 | 2/1989 | Jaquez | 273/144 B |

FOREIGN PATENT DOCUMENTS

| | | | |
|---|---|---|---|
| 2455777 | 1/1981 | France | 273/144 B |
| 2553153 | 7/1976 | Germany | 273/144 B |

*Primary Examiner*—Benjamin H. Layno

[57] ABSTRACT

A reversible beverage coaster and lottery number picker having an opaque base, transparent covers attached to upper and lower portions of the base and a plurality of small disks in upper and lower cavities of the base. In the upper and lower cavities are traps for capturing some of the disks. The number of disks which can be captured by the traps is related to the lengths of the traps. The center portions of the transparent covers are depressed for supporting beverage glasses. Each of the disks has a number marked on opposite circular faces. Lottery numbers are generated by agitating the coaster to randomly position the disks inside of the coaster and then rotating the coaster to capture disks in the traps.

11 Claims, 6 Drawing Sheets

UNITED STATES LOTTERIES

| State/U.S. Possession | Daily | Weekly/ Semi-Weekly |
|---|---|---|
| Arizona | | X |
| California | X | X |
| Colorado | | X |
| Connecticut | X | X |
| Washington, D.C. | X | X |
| Delaware | X | X |
| Florida | X | X |
| *Georgia | | |
| Idaho | | X |
| Illinois | X | X |
| Indiana | X | X |
| Iowa | | X |
| Kansas | X | X |
| Kentucky | X | X |
| Louisiana | X | X |
| Maine | X | X |
| Maryland | X | X |
| Massachusetts | X | X |
| Michigan | X | X |

| State/U.S. Possession | Daily | Weekly/ Semi-Weekly |
|---|---|---|
| Minnesota | X | X |
| Missouri | | X |
| Montana | | X |
| *Nebraska | | |
| New Hampshire | X | X |
| New Jersey | X | X |
| New York | X | X |
| Northern Mariana Isles | | |
| Ohio | X | X |
| Oregon | X | X |
| Pennsylvania | X | X |
| South Dakota | | X |
| Texas | | X |
| Vermont | | X |
| **Virgin Islands | | |
| Virginia | X | X |
| Washington | | X |
| West Virginia | X | X |
| Wisconsin | X | X |

*Lottery will become operational in 1993

**Instant Lottery Only

*FIG. 29*

COMBINED COASTER AND LOTTERY NUMBER PICKER

FIELD OF THE INVENTION

This invention relates to beverage glass coasters and lottery number pickers and more particularly to a combined beverage glass coaster and lottery number picker (hereinafter sometimes "coaster")

BACKGROUND OF THE INVENTION

Beverage glass coasters prevent damage to furniture and table coverings from hot and corrosive liquids. They also protect against condensation on cold beverage glasses.

Government lotteries are one of the world's major industries. They have been adopted by over 30 American States, U.S. Protectorates (Northern Mariana Islands and U.S. Virgin Islands), Canada, Sweden, France, Australia, Austria, Switzerland and Canada. The lotteries of the United States and its Protectorates are shown in FIG. 29.

During 1991, over 21 billion dollars in revenue was generated by state lotteries. The 21 billion dollars equalled the combined income of America's five most profitable corporations. Lotteries have been so widely accepted that it is believed that the U.S. government may soon adopt a national lottery as a means for trimming budget deficits.

The large prizes, commonly in excess over one million dollars, have attracted millions of betters. Lotteries are a means for an ordinary citizen to acquire a fortune which heretofore may not have been accessible.

Although picking lottery numbers is a simple task, many betters prefer using random number generators for picking lottery numbers. Heretofore, random number generators have not had widespread application because of the great diversity in lotteries.

By way of example, in thirty weekly and semi-weekly state lotteries, players select six numbers from thirteen different sets of numbers. In eight weekly and semi-weekly state lotteries, players select five numbers from six different sets of numbers. Still further, seven states operate three-digit number daily lotteries, two states operate four-digit number lotteries and sixteen states operate three and four-digit daily lotteries.

SUMMARY OF THE INVENTION

The present invention is an easy to use coaster and lottery number picker with wide application to the variety of U.S. and foreign lotteries. Moreover, the invention allows for a variety of overall attractive shapes, including a circular, square, pentagon, hexagon, octagon, decagon and diamond.

In one embodiment, the coaster and lottery number picker has an opaque base with a cylindrical cavity, a plurality of thin disks stored in the cavity and a transparent cover for viewing the disks in the cavity. Inside the cavity is a trap for capturing some of disks.

The number of disks which can be captured in the trap is related to the length of the trap. The trap allows disks to easily enter but resists disks from leaving the trap. In another embodiment thin cylindrical disks are stored in upper and lower cavities of a base for randomly selecting lottery numbers for several different lotteries.

Lottery numbers are selected by agitating the coaster to randomly orient the disks in the cavity and then rotating the coaster to fill the trap. As the coaster is rotated, the disks are caused by centrifugal force to move outwardly and pile up at the entrance of the trap. A ramp at the entrance joins the trap's outer wall with the outer wall of the cavity. Inertial forces cause the disks to move up the ramp and enter the trap.

As disks move up the ramp and enter the trap, they cause adjacent disks to move toward and from the entrance of the trap, thereby preventing disks from leaving the trap. After the trap has been filled, an end portion of the trap resists a flow of disks out of the trap.

Another feature of the invention is the reversibility of the coaster. Another feature is that the coaster can be adapted to pick numbers for three and four-digit daily lottery numbers as well as sets of five or six weekly lottery numbers.

Another feature is that the thin cylindrical disks easily enter the trap but are inhibited from leaving the trap.

Lottery numbers are randomly generated by agitating the coaster to randomly orient the disks and then rotating the coaster to capture some of the randomly oriented disks in the trap.

Further benefits and features of the invention will be apparent from the ensuing description and accompanying drawings which describe the invention in detail. A preferred embodiment is disclosed in accordance with the best mode which is contemplated for practicing the invention and the specific features in which exclusive property rights are claimed are set forth in each of the numbered claims which are appended to the detailed description.

BRIEF DESCRIPTION OF THE DRAWINGS

FIG. 29 is a chart showing the lotteries in various states and possessions of the United States.

DETAILED DESCRIPTION OF THE PREFERRED EMBODIMENT

Figure 5:
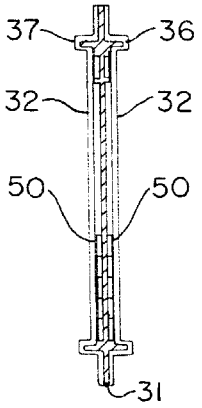
FIG. 5 is a cross-sectional view taken on the line 5—5 in FIG. 4.

Referring now to the drawings wherein like numerals designate like and corresponding parts throughout the several views, a combined coaster and lottery number picker 30 is shown in FIGS. 1 through 5, inclusive, in accordance with the present invention.

Figure 1:
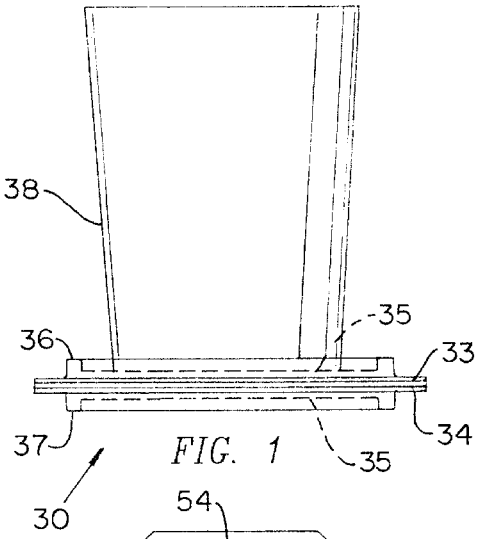
FIG. 1 is a front view of a combined coaster and lottery number picker and a beverage glass in accordance with the present invention.

The coaster 30 has a base 31 and identical transparent covers 32 attached to upper 33 and lower 34 faces of the base 31 by sonic welding or another suitable means. The base 31 is preferably molded from an opaque plastic material. The covers 32 are molded from a transparent plastic material and have depressed center portions 35 surrounded by short upward 36 and downward 37 extending vertical walls. As shown in FIG. 1, the center portions 35 are adapted to support a beverage glass 38 when the coaster 30 is supported on either the top 39 or bottom 40 covers. One benefit of this construction is that the vertical walls 36, 37 protect the center portions 35 from being scratched by surfaces on which the coaster 30 rests.

Referring now to FIGS. 21 through 28, inclusive, the coaster 30 allows for a variety of attractive overall shapes in addition to the octagon 41, including circular 42, square 43, pentagon 44, hexagon 45, decagon 46 and diamond 47 shapes.

In the center of the upper and lower portions of the base 31 are cylindrical cavities 48, 49 for storing thin cylindrical numbered disks 50. Preferably, the numbers 51 are marked on opposite circular faces of each of the disks 50 so that it will not be necessary to orient the faces of the disks in the cavities 48, 49. The disks 50 are visible to a user through the transparent top and bottom covers 32. Inside the upper 48 and lower 49 cavities are traps 52, 53 for capturing disks 50. The number of disks 50 which can be captured is related to the length of the trap 48, 49.

The quantity of disks 50 in the upper 52 and lower 53 traps is dependent on a particular lottery. By way of example, the trap 52 shown in FIG. 2 allows six disks 50 to be captured. The traps 52, 53 have an outer wall 54 which is spaced inwardly a short distance from the cavity wall 55 and an inner wall 56 which is spaced apart from the trap's outer wall 54. The end portions 57 of the trap's inner walls 56 at the entrances 58 to the traps 52, 53 hook outwardly for a short distance towards the outer walls 54. The trap's outer walls are joined to the cavity wall 55 by ramps 59.

It will be appreciated that the coaster 30 can be easily modified for different lotteries by merely changing the number of disks 50 in the cavities 48, 49. At the present time, among the states there are about seventeen different sets of numbers wherein players are required to select six numbers.

Figure 4:
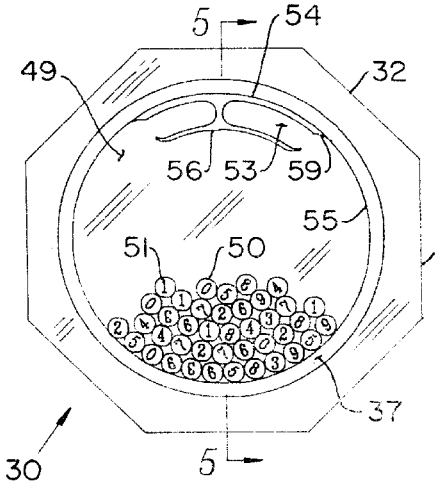
FIG. 4 is a bottom view.
Figure 3:
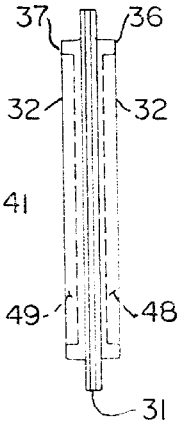
FIG. 3 is a front view without the beverage glass.
Figure 2:
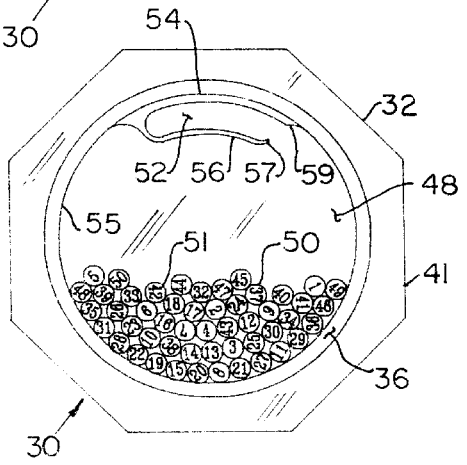
FIG. 2 is a top view.

Referring now to FIG. 4, the lower trap 53 is divided into two portions, one portion 60 has a length for capturing four disks and another portion 61 has a length for capturing three disks. The dual lower trap 53 is used for playing three or four-digit daily lotteries. In the lower cavity 49 are four sets of disks 50, each set consisting of ten disks 50 marked with the character zero and the numbers 1 through 9 on opposite circular faces.

Figure 6:
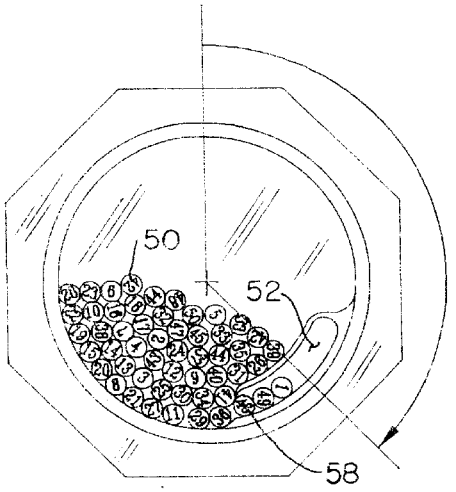
FIG. 6 is a top view at 135 degrees of clockwise revolution.

The design of the traps 52, 53 allows disks 50 to easily enter but resists disks 50 from leaving. The manner in which the traps 52, 53 operate can be understood by reference to FIGS. 2, 6 and 7 wherein a set of six disks 50, namely, #1, #49, #46, #36, #29, and #11 is randomly selected from a set of fifty disks 50 inside of the upper cavity 48. The first step in selecting the set of disks 50 consists of agitating the coaster 30 to randomly orient the disks 50. After the coaster 30 has been agitated, the coaster 30 is rotated clockwise as shown in FIGS. 6 and 7 to fill the upper trap 52.

During the clockwise rotation of the coaster 30, centrifugal and inertial forces cause the disks 50 to pile-up at the entrance 58 to the trap 52. As shown in FIG. 6, disk #36 which is closest to the entrance 58 is pushed up the ramp 59 to enter the trap 52. The movement of disk #36 up the ramp 59 causes disk #41 and other overlying disks 50 to be displaced upwardly and away from the trap 52, thereby allowing disk #36 to enter the trap 52. When the trap 52 is full, as shown in FIG. 7, the disks 50 at the entrance 58 move downwardly, preventing the disks 50 from leaving the trap 52. Thus, the disks 50 function as a gate at the entrance 58 to the trap 52.

Figure 7:
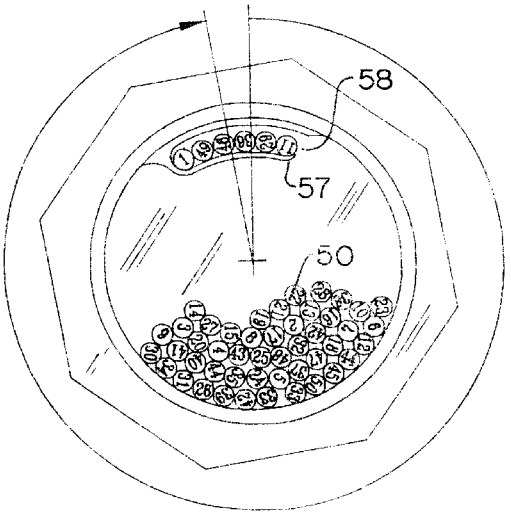
FIG. 7 is a top view at 350 degrees of clockwise revolution.

During the clockwise rotation of the coaster 30 to the position shown in FIG. 7, disks 50 outside of the trap 52 fall by gravity away from the trap 52. However, until the disks 50 fall away from the trap 52, they impede a flow of disks 50 from the trap 52. After the trap 52 is in the near horizontal position shown in FIG. 7, the hooked end portion 57 of the trap 52 impedes the flow of disks 50 out of the trap 52.

Figure 9:
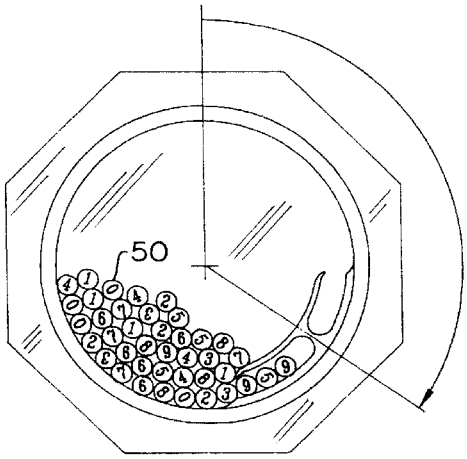
FIG. 9 is a bottom view at 135 degrees of clockwise rotation.
Figure 8:
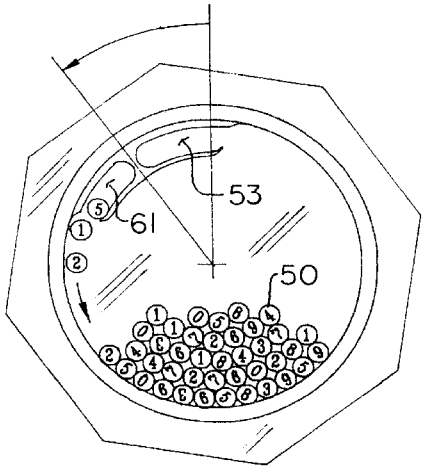
FIG. 8 a bottom view at 45 degrees of counterclockwise rotation.
Figure 10:
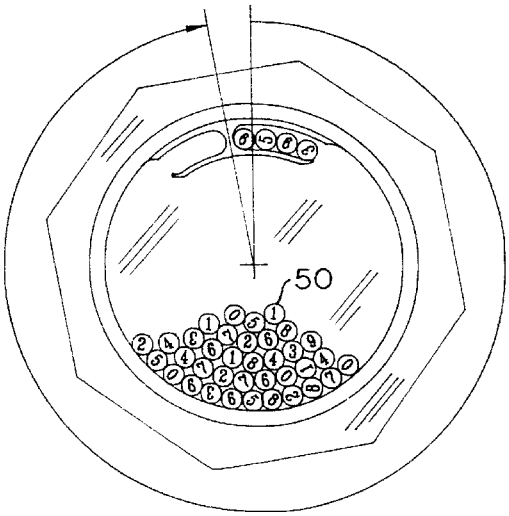
FIG. 10 is a bottom view at 350 degrees of clockwise rotation.
Figure 11:
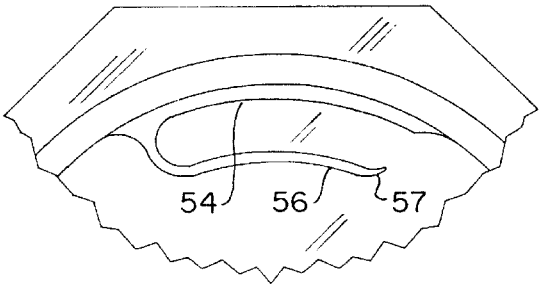
FIG. 11 is an enlarged partial view of FIG. 2 showing a trap for capturing some thin cylindrical disks.

The random selection of the four-digit number 6563 is depicted in FIGS. 8 through 10. The coaster 30 is shown first rotated counterclockwise as depicted in FIG. 8, to empty disks #2, #1, #5 from the portion 61 of the trap 53 used for selecting three-digit numbers. Next, the coaster 30 is rotated in a clockwise position as shown in FIGS. 9 and 10 to capture disks #6, #5, #6, #3 in the other portion 60 of the trap. During the clockwise rotation, disks 50 are captured in the same manner previously described for capturing six of the disks 50 in the trap 52 of the upper cavity 48.

Figure 14:
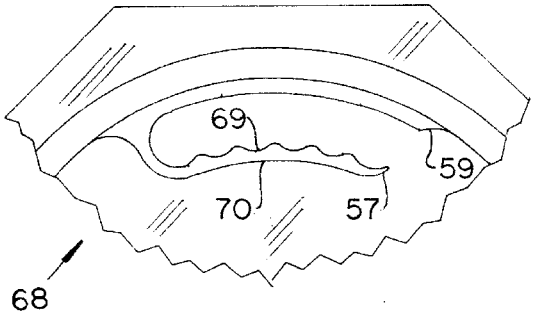
FIG. 14 is an alternate embodiment of the trap shown in FIG. 11.
Figure 13:
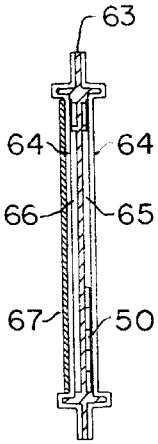
FIG. 13 is a cross-sectional view taken on the line 11—11 in FIG. 12.
Figure 12:
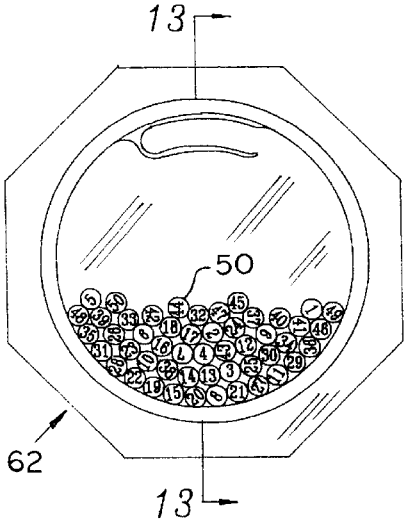
FIG. 12 is a top view of an alternate embodiment having a single plurality of thin cylindrical disks.
Figure 17:
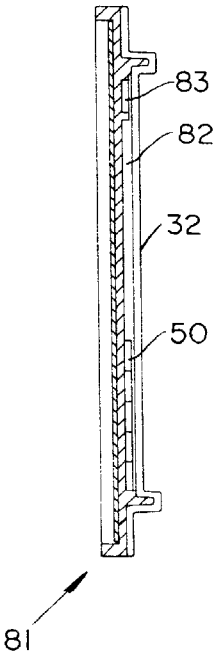
FIG. 17 is another alternate embodiment taken in the same manner as FIG. 5.
Figure 16:
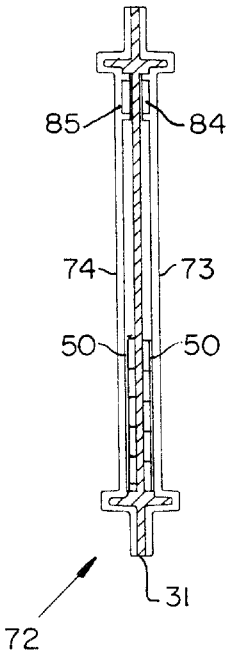
FIG. 16 is a cross-sectional view of an alternate embodiment taken in the same manner as FIG. 5.
Figure 15:
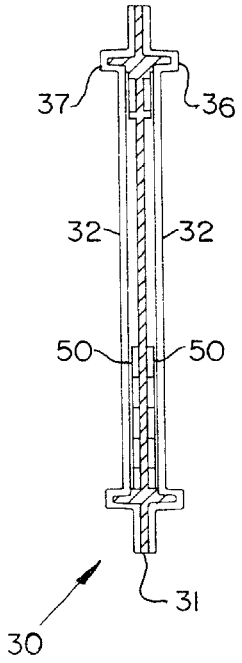
FIG. 15 is an enlargement of the cross-sectional view of FIG. 5.

In FIGS. 12 and 13, an embodiment 62 is shown wherein the same base 63 and identical covers 64 are used in separate coasters 62 for separate daily or weekly lottery numbers. In this embodiment 62, either the upper 65 or lower cavity 66 is loaded with disks 50 and the empty cavity 66 is covered by a label 67 which is attached to the center portion of the cover 64. In FIG. 14 an embodiment 68 is shown wherein concave depressions 69 are provided in the inner wall 70 of a trap 71 for further resisting the flow of disks 50 out of the trap 71. In FIG. 16 an embodiment 72 is shown wherein traps 84, 85 are formed as integral portions of upper 73 and lower 74 covers. In FIG. 17 an embodiment 81 having a single cavity 82 and trap 83 and a single cover 32 is shown.

Referring now to FIGS. 18 through 23, a circular embodiment 75 is shown having a base 76 with upper 77 and lower 78 triangular shaped cavities for storing pluralities of thin cylindrical disks 50. A single trap 79 in the upper cavity 77 is provided for capturing six of the disks 50 stored in the upper cavity 77 and a dual trap 80 in the lower cavity 78 is configured to capture either three or four of the disks stored in the lower cavity 78.

Figure 20:
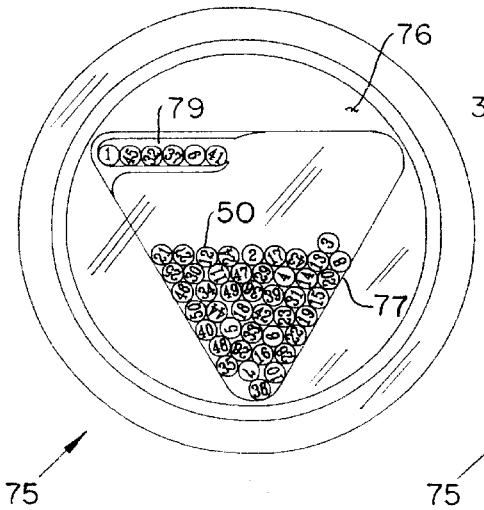
FIG. 20 is the top view of the alternate embodiment at 360 degrees of clockwise rotation.
Figure 19:
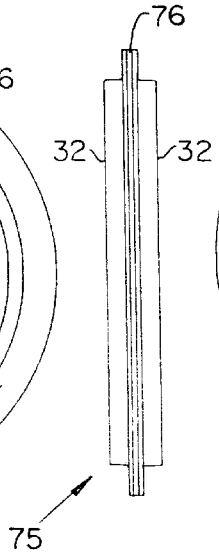
FIG. 19 is a front view of the alternate embodiment of FIG. 18.
Figure 18:
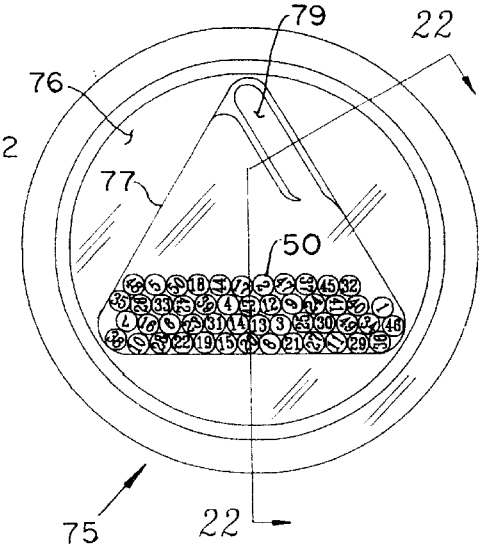
FIG. 18 is a top view of another alternate embodiment.
Figure 23:
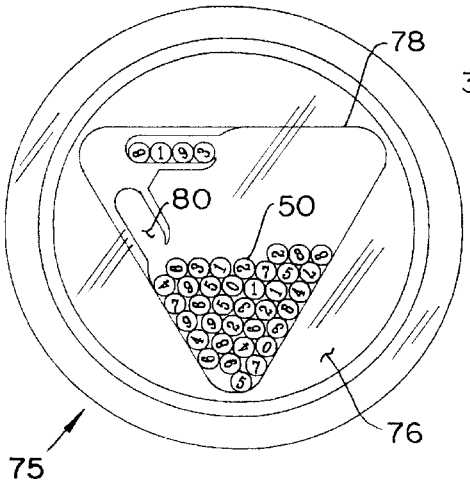
FIG. 23 is a bottom view of the alternate embodiment of FIG. 18 at 360 degrees of clockwise rotation.
Figure 22:
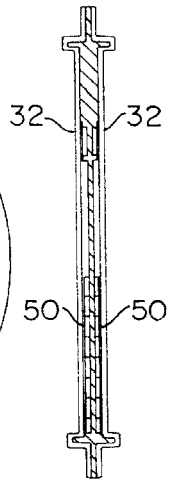
FIG. 22 is a cross-sectional view taken on the line 22—22 in FIG. 18.
Figure 21:
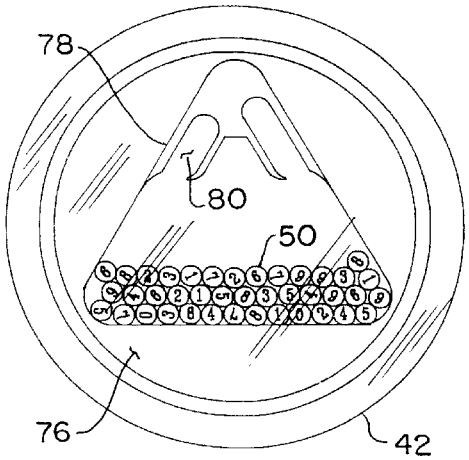
FIG. 21 is a bottom view of the alternate embodiment of FIG. 18.
Figure 25:
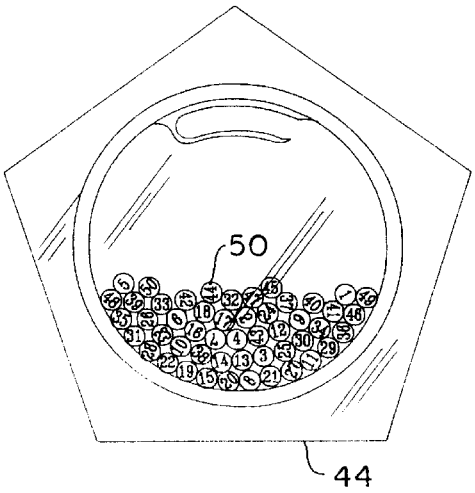
FIG. 25 is a top view of an alternate embodiment having an overall pentagon shape.
Figure 24:
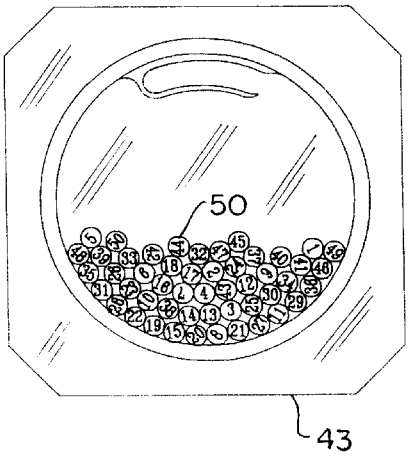
FIG. 24 is a top view of an alternate embodiment having an overall square shape.
Figure 27:
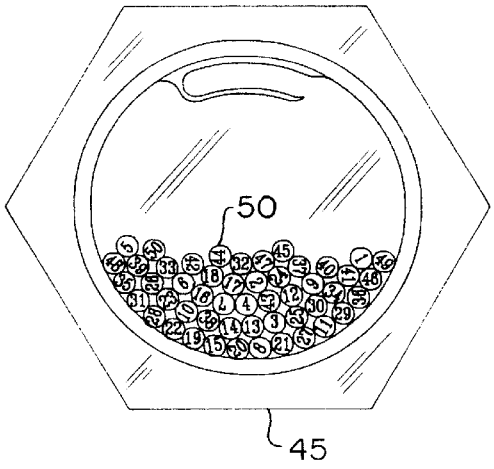
FIG. 27 is a top view of an alternate embodiment having an overall hexagon shape.
Figure 26:
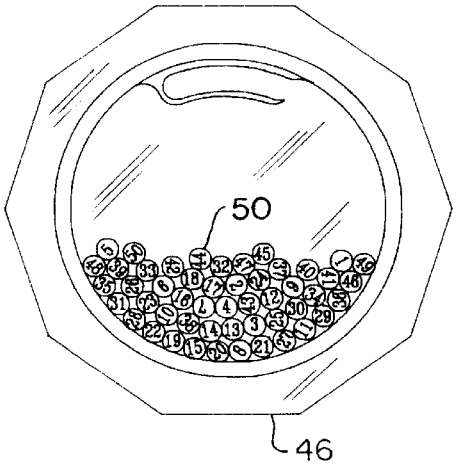
FIG. 26 is a top view of an alternate embodiment having an overall decagon shape.
Figure 28:
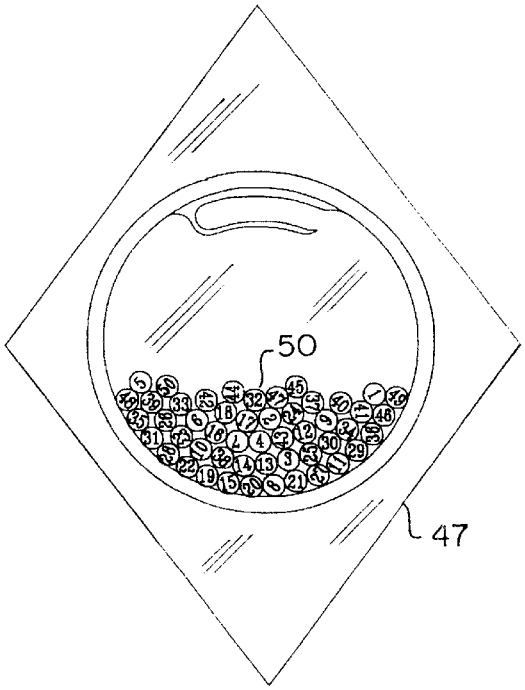
FIG. 28 is a top view of an alternate embodiment having an overall diamond shape.

In FIG. 20 the coaster 72 is shown after a clockwise rotation with six of the disks captured in the upper trap 79 and in FIG. 23 the coaster is shown after a clockwise rotation with four disks captured in the lower trap 80.

From the foregoing it will be appreciated that my invention provides benefits heretofore unavailable in either a beverage glass coaster or lottery number picker.

Although but several embodiments have been illustrated and described, it will be understood that other embodiments can be derived by changes in shape and materials as well as numbers and substitutions of parts without departing from the spirit thereof.

I claim:

1. A combined beverage glass coaster and lottery number picker comprising: a base, said base having at least one cavity; a transparent cover attached to said base in covering relationship to said cavity, said cover having a depressed center portion for supporting a beverage glass and a trap in said cavity for capturing thin cylindrical disks stored in said cavity to randomly pick a lottery number, said trap comprised of an outer wall spaced inwardly a short distance from an outermost wall of said cavity, an inner wall spaced inwardly from said trap's outer wall, said inner wall having a hook-end portion for resisting a flow of captured disks out of said open end of said cavity, and a ramp at said trap's open end, said ramp connecting said cavity's outermost wall and said trap's outer wall; and a plurality of thin cylindrical disks inside of said cavity, each of said disks having a pair of opposite circular faces and a number marked on each of said circular faces.

2. The device recited in claim 1 wherein said transparent cover is attached to said base by sonic welding.

3. The device recited in claim 1 further comprising said inner wall of said trap having a plurality of concave depressions facing said outer wall for further resisting said disks from flowing out of said trap.

4. The device recited in claim 1 further comprising a second means in said cavity for capturing thin cylindrical disks stored in said cavity for randomly picking a number for another lottery.

5. The device recited in claim 4 further comprising a second cavity in said housing and a means in said second cavity for capturing thin cylindrical disks stored in said second cavity for randomly picking numbers for yet another lottery.

6. The device recited in claim 5 wherein one of said means for capturing disks is adapted to randomly pick a number for a three-digit number lottery, one of said means for capturing disks is adapted for randomly picking a number for a four-digit number lottery, and one of said means for capturing disks is adapted for picking six numbers for a lottery.

7. The lottery number selector recited in claim 1 wherein said means for capturing disks is adapted for randomly picking numbers for three and four-digit number lotteries.

8. A combined beverage glass coaster and lottery number picker comprising: a base, said base having at least one circular cavity and an annular trap open at one end in said cavity for capturing thin cylindrical disks stored in said cavity, said trap comprised of an outer wall spaced inwardly a short distance from an outermost wall of said cavity, an inner wall spaced inwardly from said trap's outer wall, said inner wall having a hook-end portion for resisting a flow of captured disks out of said open end of said cavity; a plurality of thin cylindrical disks stored in said cavity, each of said disks having a number marked on a circular face of said disk; and a transparent cover attached to said base for viewing said numbers on said disks, said cover having a depressed center portion which is adapted for supporting a beverage glass.

9. The device as recited in claim 8 wherein said trap has an arcuate outer wall and an arcuate inner wall spaced apart from said arcuate outer wall, said arcuate inner wall having an end portion extending a short distance outwardly toward said outer wall for impeding disks from flowing out of said trap.

10. The device as recited in claim 8 wherein said trap has an outer wall spaced inwardly from an outer wall of said cavity, said outer wall having an end portion at said open end of said trap which is joined to said outer wall of said cavity by a ramp.

11. The device recited in claim 8 wherein said base is opaque.

* * * * *